US011885223B2

(12) United States Patent
Slaughter, Jr. et al.

(10) Patent No.: US 11,885,223 B2
(45) Date of Patent: Jan. 30, 2024

(54) METHOD TO PREVENT DUAL ROD DRILL STRING DRAG

(71) Applicant: The Charles Machine Works, Inc., Perry, OK (US)

(72) Inventors: Greg L. Slaughter, Jr., Perry, OK (US); Joseph G. Greenlee, Perry, OK (US); Joe Glenn Worlow, The Villages, FL (US)

(73) Assignee: The Charles Machine Works, Inc., Perry, OK (US)

( * ) Notice: Subject to any disclaimer, the term of this patent is extended or adjusted under 35 U.S.C. 154(b) by 587 days.

(21) Appl. No.: 17/072,872

(22) Filed: Oct. 16, 2020

(65) Prior Publication Data

US 2021/0115777 A1 Apr. 22, 2021

Related U.S. Application Data

(60) Provisional application No. 62/916,339, filed on Oct. 17, 2019.

(51) Int. Cl.

| | |
|---|---|
| ***E21B 7/04*** | (2006.01) |
| ***E21B 47/007*** | (2012.01) |
| ***E21B 7/00*** | (2006.01) |

(52) U.S. Cl.

CPC ..... *E21B 7/046* (2013.01); *E21B 7/002* (2013.01); *E21B 47/007* (2020.05)

(58) Field of Classification Search

CPC ..... E21B 7/046; E21B 7/002; E21B 47/007; E21B 44/00; E21B 6/04

See application file for complete search history.

(56) References Cited

U.S. PATENT DOCUMENTS

| | | | | |
|---|---|---|---|---|
| 5,682,956 | A * | 11/1997 | Deken | E21B 17/042 175/19 |
| RE38,418 | E | 2/2004 | Deken et al. | |
| 7,641,000 | B2 | 1/2010 | Albert | |
| 10,208,580 | B2 * | 2/2019 | Benson | E21B 47/09 |
| 2004/0028476 | A1 * | 2/2004 | Payne | E21B 44/00 405/184 |
| 2019/0277099 | A1 * | 9/2019 | Slaughter, Jr. | E21B 19/166 |

* cited by examiner

*Primary Examiner* — Nicole Coy
*Assistant Examiner* — Nicholas D Wlodarski
(74) *Attorney, Agent, or Firm* — Tomlinson McKinstry, P.C.

(57) ABSTRACT

An apparatus and method for preventing drill string drag. Rotation encoders are provided for tracking the rotation of an inner and outer member of a dual-member drill string. Based upon the drilling conditions, the readings of the encoder can detect when the inner member is dragging on the outer member. When such a drag condition is detected, a processor can trigger remedial measures, which may include increasing a rotation rate of the inner member, sending a warning signal, stopping operation, or a combination of these.

20 Claims, 5 Drawing Sheets

METHOD TO PREVENT DUAL ROD DRILL STRING DRAG

SUMMARY

The present invention is directed to a system. The system comprises first and second motors, an elongate hollow outer member, an elongate inner member, a first and second rotation sensor, and a processor. The outer member is rotationally coupled to the first motor. The first rotation sensor detects the outer member's rotation and sends a first signal. The inner member is disposed within the outer member and coupled to the second motor. The second rotation sensor detects the inner member's rotation and sends a second signal. The processor has a memory. The processor is configured to store a predetermined drag condition in its memory and receive the first and second signals. Using the first signal, the processor is configured to determine a rotation rate of the elongate hollow member. Using the second signal, the processor is configured to determine a rotation rate of the elongate inner member. The processor then may compare the rotation rate of the inner member and the rotation rate of the elongate hollow outer member to the predetermined drag condition.

In another aspect, the invention is directed to a method for rotating a drill string. The drill string comprises an outer pipe string and an inner pipe string. The method comprises storing, in a memory, predetermined drill string rotation conditions indicative of a drag condition between the inner pipe string and the outer pipe string. The method further comprises rotating the inner and outer pipe strings using a first and second motor, respectively. A first and second rotation rate is measured. At least one of the first and second rotation rate is compared to the predetermined drill string conditions.

DETAILED DESCRIPTION

Figure 1:
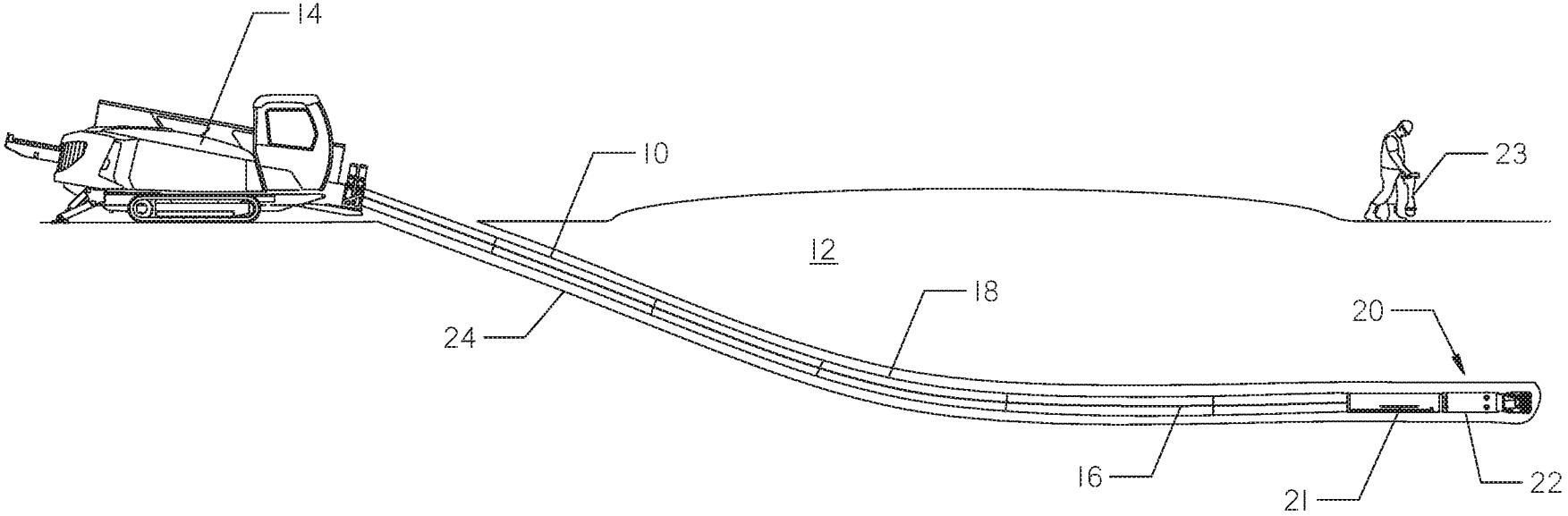
FIG. 1 is a diagrammatic representation of a horizontal directional drilling machine having a two-pipe drill string engaged in a pilot boring operation.

Horizontal directional drilling (HDD) often utilizes a dual rod drill string 10 to drill into an underground formation 12. Thrust and rotation is provided to the drill string 10 by a horizontal directional drilling unit 14. Examples of horizontal directional drilling units suitable for a dual member drill string 10 are found in, for example, U.S. Pat. No. RE38,418, issued to Deken, et al., which is hereby incorporated by reference.

The dual rod drill string 10 consists of an inner pipe 16 and an outer pipe 18 which surrounds the inner pipe 16. The drill string 10 is formed in individual sections, which may be added or removed at the horizontal directional drill 14.

The inner pipe 16, which is formed in segments to form an inner drill string, is intended to drive a downhole tool containing a drill bit 20 in a rotational manner. The outer pipe 18, also formed in segments to form an outer drill string, imparts thrust and pullback forces to the drill bit 20 through a series of roller or journal bearings. The outer pipe 18 is also rotationally driven to orient a bent sub 22 or steering shoe for path corrections. The inner 16 and outer 18 pipe coordinate to advance the drill bit 20 through the earthen formation 12, opening a borehole 24.

Progress of the borehole 24 and the drill bit 20 is tracked using a below ground beacon 21 which emits a magnetic field received at an above-ground tracker 23. The beacon 21 and tracker 23 are used by the operator of the drill 14 to determine whether or not the borehole 24 is progressing along its planned below-ground path.

Clearances between the inner 16 and outer 18 drill strings ensure free movement of the inner drill string within the outer. Clearances also cause the thrust forces from the outer drill string 18 to be imparted proximate the drilling bit 20.

Figure 5:
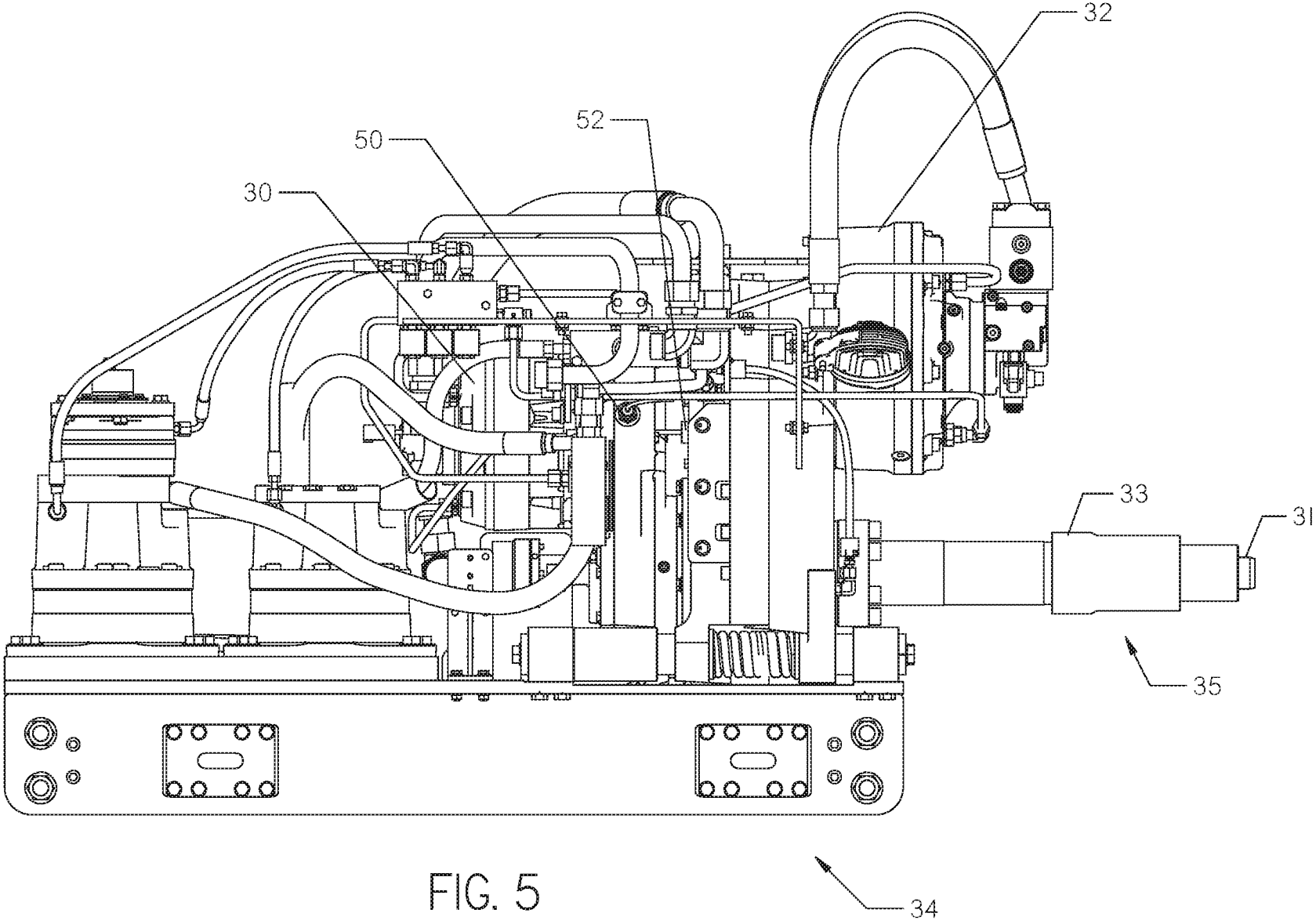
FIG. 5 is a side view of a carriage for a horizontal directional drill. The carriage has separate motors and encoders for an inner and outer drive shaft, which are, in turn, connectable to the two-pipe drill string of FIGS. 1-3.

For a dual rod HDD drill 14, the inner pipe 16 is often driven by a first hydraulic motor 30 (FIG. 5). The first hydraulic motor 30 imparts rotation to an inner drive shaft 31, which in turn connects to the inner pipe 16 for use at the drill bit 20 as described above. The outer pipe 18 is rotationally driven by a second hydraulic motor 32. The second hydraulic motor 32 imparts rotation to an outer drive shaft 33 which is connected to the outer pipe 18. The second hydraulic motor 32 may be capable of rotational torque that exceeds the rotational torque of the first hydraulic motor 30. The first 30 and second 32 hydraulic motors are supported on a carriage 34, which translates along the HDD drill 14 frame to impart thrust to the drill string 10.

The inner 31 and outer 33 drive shaft are collectively referred to as a dual-pipe spindle 35. The spindle 35 is carried by the carriage 34, and thus transfers thrust and rotation to the drill string 10.

Figure 2:
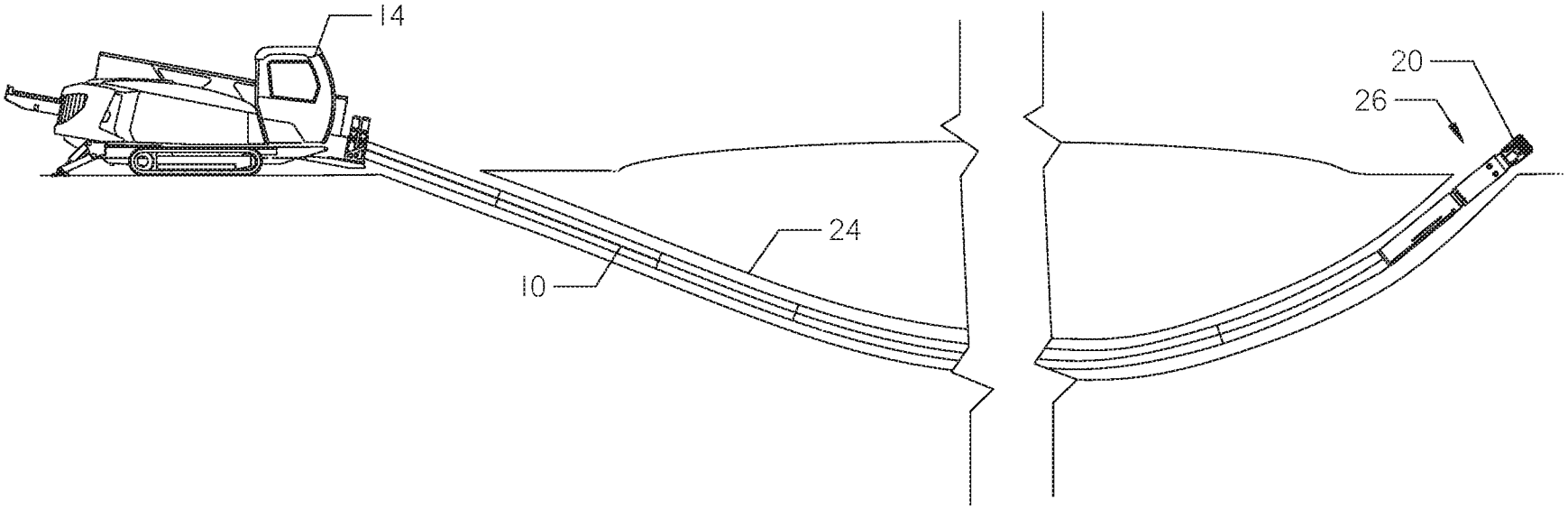
FIG. 2 is a diagrammatic representation of a horizontal directional drilling machine having a two-pipe drill string engaged in a pilot boring operation, with the downhole tool at a bore out position.

With reference to FIGS. 1, 2 and 5, during dual rod pilot boring, the first hydraulic motor 30 for the inner pipe 16 will often be used at an elevated duty cycle when compared to the duty cycle of the second hydraulic motor 32. In conditions such as rock, thrust alone cannot advance the drill bit 20. In those conditions, inner pipe 16 rotation must be engaged when thrust is imparted to a drilling bit 20 in order to open the borehole.

Figure 3:
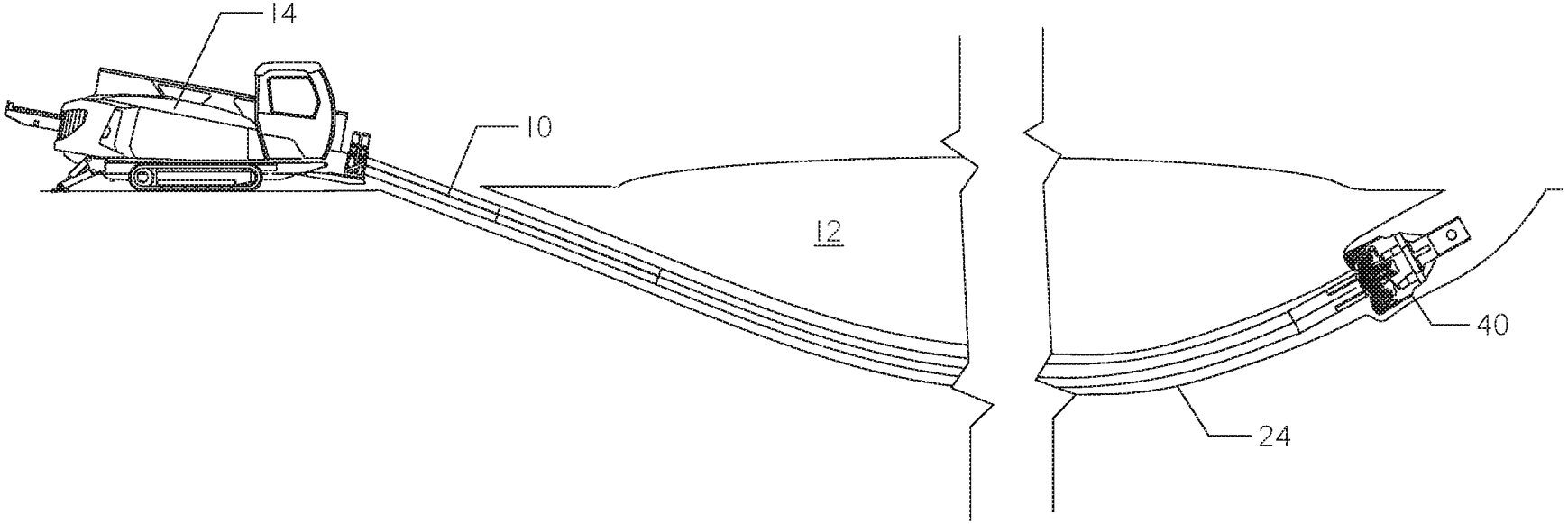
FIG. 3 is a diagrammatic representation of a horizontal directional drilling machine having a two-pipe drill string engaged in a backreaming operation.

During certain conditions, the inner pipe 16 is not used and completely disengaged. As shown in FIG. 2, the drill bit may exit the borehole 24 at an exit point 26. A backreamer 40, as shown in FIG. 3, may be attached to the drill string 10 and pulled back towards the HDD drill 14. The backreamer 40 enlarges the borehole 24 made during pilot boring.

When backreaming, or when pulling back product pipe for utility installation, the inner pipe 16 may be completely disengaged from the first hydraulic motor 30. When the inner pipe 16 is disengaged, the outer pipe 18 is used exclusively for all rotational needs due to the higher rotational torque available from the second hydraulic motor 32. When the inner pipe 16 is not being used, rotational movement of the outer pipe 18 can induce drag on the inner pipe through contact friction between the two components of the drill string 10.

Typically, this contact is incidental. When incidental, the force exerted by the contact is limited to the weight of the inner pipe 16. The outer surface of the inner pipe 16 will lay on the internal surface of the outer pipe 18. In such incidental situations, the rotational torque imparted to each individual inner pipe 16 from the rotation of the outer pipe 18 is incremental and negligible. Ordinary operation of the hydraulic components that drive the inner pipe 16, including the first hydraulic motor 30, allow rotation in the same direction as the outer pipe 18 at a limited speed without causing harm. The limited speed may be about 5 rpm in current systems, subject to hydraulic design and clearances.

As HDD methods have advanced and drill pipe strengths have increased, tighter bend radii are permitted for use in utility and pipeline installation. Difficult bores and obstacles can cause HDD pilot bore-paths to encounter sharp expected or unexpected deviations. These deviations cause the outer drill pipe 18 to deflect, curve, and bend, while the inner pipe 16 inside of the outer pipe has no such motivation to follow the same curvature due to the clearances mentioned above. If the deviation of the outer pipe 18 becomes great enough that the clearance between the inner pipe 16 and the outer pipe 18 are eliminated, contact forces in excess of incidental gravity-based contact forces described above can begin to materialize and appreciate. If these forces increase enough, the friction between the inner 16 and outer 18 drill strings will increase.

The forces generated by the frictional contact act to hinder rotation of the inner pipe 16, the outer pipe 18, or both unless the two strings are rotating at the same rotational speed. This phenomenon can appreciably impede torque availability at the drilling tool (whether drill bit 20 or backreamer 40) further down the drill string 10, and may be referred to as "dragging" the inner pipe 16.

This dragging action, should it occur when the inner pipe 16 is being driven, can and will stall the inner pipe 16 and drill bit 20 if the contact is adequately increased. In rock conditions, stalling the inner pipe 16 would effectively halt pilot bore drilling operations. In this case, the operator can then correct the deviation or elect a different borepath to alleviate the binding between the inner 16 and outer 18 pipes.

Unfortunately, a bore-path 24 can be defined in such a way that the outer pipe 18 does not deviate enough to cause binding with the inner pipe 16 during bore out operations (FIG. 2), but does during subsequent hole-enlarging or pullback operations (FIG. 3). In some situations, the outer drill pipe 18 is subjected to tighter bend radii during backreaming than during boreout.

If the binding becomes severe enough that the inner pipe 16 is being driven by the outer pipe 18, the outer pipe 18 will also drive the first hydraulic motor 30 on the directional drilling unit. In some applications, the inner pipe 16 may be coupled with the outer pipe 18 in order to combine the torque carried by both inner and outer drill strings. However, if the inner pipe 16 is not intended to rotate or carry rotational torque, a portion of the rotational torque being supplied to the outer drill string by the second hydraulic motor 32 of the horizontal directional drilling unit 14 will be imparted to the inner pipe 16 through the contact. Such contact will "overdrive" the hydraulic drive circuit of the first hydraulic motor 30.

The consequences of this "overdrive" scenario are much deeper than a simple power loss to the outer drill string 18. Often the pressure relief system for such hydraulic drives can build excessive amounts of heat if driven in such a manner. Because the first hydraulic motor 30 is essentially being converted into a pumping system in this scenario, the power needed to turn the inner pipe 16 is imparted to the hydraulic circuit and pumped over a high pressure relief, increasing the temperature of the oil.

Other "overdriven" scenarios may include those in which the bearings on the downhole tool, or drill head 20 where the outer drill rod 18 thrust forces are transferred onto the inner rotational drive have failed. In this situation, the erratic shapes and sizes of the failed bearing's pieces can bind in the drill head cavity housing them. This can effectively cause the inner rotation to bind to the outer rotation. Thus, any time the outer drill string is rotated, the inner drive is overdriven.

In order to avoid power loss and hydraulic system component damage via wasted and unused power, one could control the first hydraulic motor 30 rotational speed to avoid the scenario. The inner pipe 16 rotational speed, when needed, would act independently of the outer pipe 18, rotating at the desired speed and experiencing drag based only on gravitational weight of the components.

When drilling in rock, the drill 14 is placed into a first mode. In the first mode, referred to as "Rock Mode", the inner pipe 16 is intentionally rotating faster than the outer pipe 18. As long as the rotation speed of the inner pipe 16 exceeds the rotation speed of the outer pipe 18, the operation is proceeding properly.

If the rotation speed of the inner 16 and outer pipes 18 are equal in "Rock Mode", it indicates that the inner pipe 16 is dragging against the outer pipe 18 (a "drag condition"). This is a problem, and may indicate that the drill string is damaged or overbending.

If rotation speed of the inner pipe 16 is less than the outer pipe 18, damage to downhole tools such as drill bits 20 may result. Certain drilling tools are designed to function when the inner pipe 16 is rotating at speeds that are the same or greater than the outer pipe 18. For these tools, rotating the outer pipe 18 without rotating the inner pipe 16 can result in disassembling the tool itself while in the borehole 24.

When not in "Rock Mode", the inner pipe 16 is disengaged. Applications for disengaging the inner pipe 16 from the first hydraulic motor 30 include dirt drilling and backreaming. Even though the inner pipe 16 is disengaged from the first hydraulic motor 30, its speed may still be monitored. This mode is referred to as "Outer Pipe Mode".

In "Outer Pipe Mode", rotation speeds of greater than 10 to 15 rotations per minute indicate that the inner pipe 16 is dragging (a "drag condition") and being driven by the outer pipe 18. At higher speeds, this may result in power loss and damage. To prevent such damage, the first hydraulic motor 30 may engage the inner pipe 16 to match the rotational speed of the outer pipe 18.

Once the condition matching inner and outer rotation speeds is activated, a time-based, cyclical system check may disengage the condition periodically. Alternatively, the condition may be disengaged when a pipe section is broken out from or added to the pipe string. Upon disengaging the condition, rotational speed of the inner pipe 16 is again monitored while the first hydraulic motor 30 is disengaged. If the inner speed of the inner pipe 16 decreases to less than 10-15 rpm, normal operation of "Outer Pipe Mode" can continue.

With reference to FIG. 5, an inner rotation encoder 50 and an outer rotation encoder 52 are used at the carriage 34 of the horizontal directional drill to record the rotation speed of each of the inner pipe 16 and the outer pipe 18. Such encoders 50, 52 may be magnetic in nature. Both the frequency and direction of rotation are capable of detection from signals generated from the encoders 50, 52. The encoders 50, 52 may be utilized either on the spindle of the horizontal directional drill itself, or in a part of the gearing mechanism used to power such spindles. As shown, the inner drive encoder 50 is coupled to the gearing mechanism while the outer drive encoder 52 rotates with the spindle 35 itself.

Other means for detecting rotation in a spindle 35 may be used and include tachometers, magnetic sensors, optical encoders, and the like. Further, when such means for detecting are unidirectional in nature, rotation direction may be inferred from inputs such as hydraulic pressures, valve positions, and downhole electronics. In one preferred embodiment, the rotation encoders 50, 52 are incremental encoders with 0.3 degree resolution, capable of determining the absolute rotational position of the inner drive shaft 31 and outer drive shaft 33 of the spindle 35.

The rotation encoders 50, 52 send signals to a processor. The processor has a memory. The processor is capable of comparing rotation speeds of the inner 16 and outer 18 pipes and, based on predetermined parameters which indicate the dragging condition, provide the information to an operator. Additionally, the processor is capable of performing steps to mitigate the effects of drill string 10 drag, such as increasing the speed of the inner pipe 16.

Figure 4:
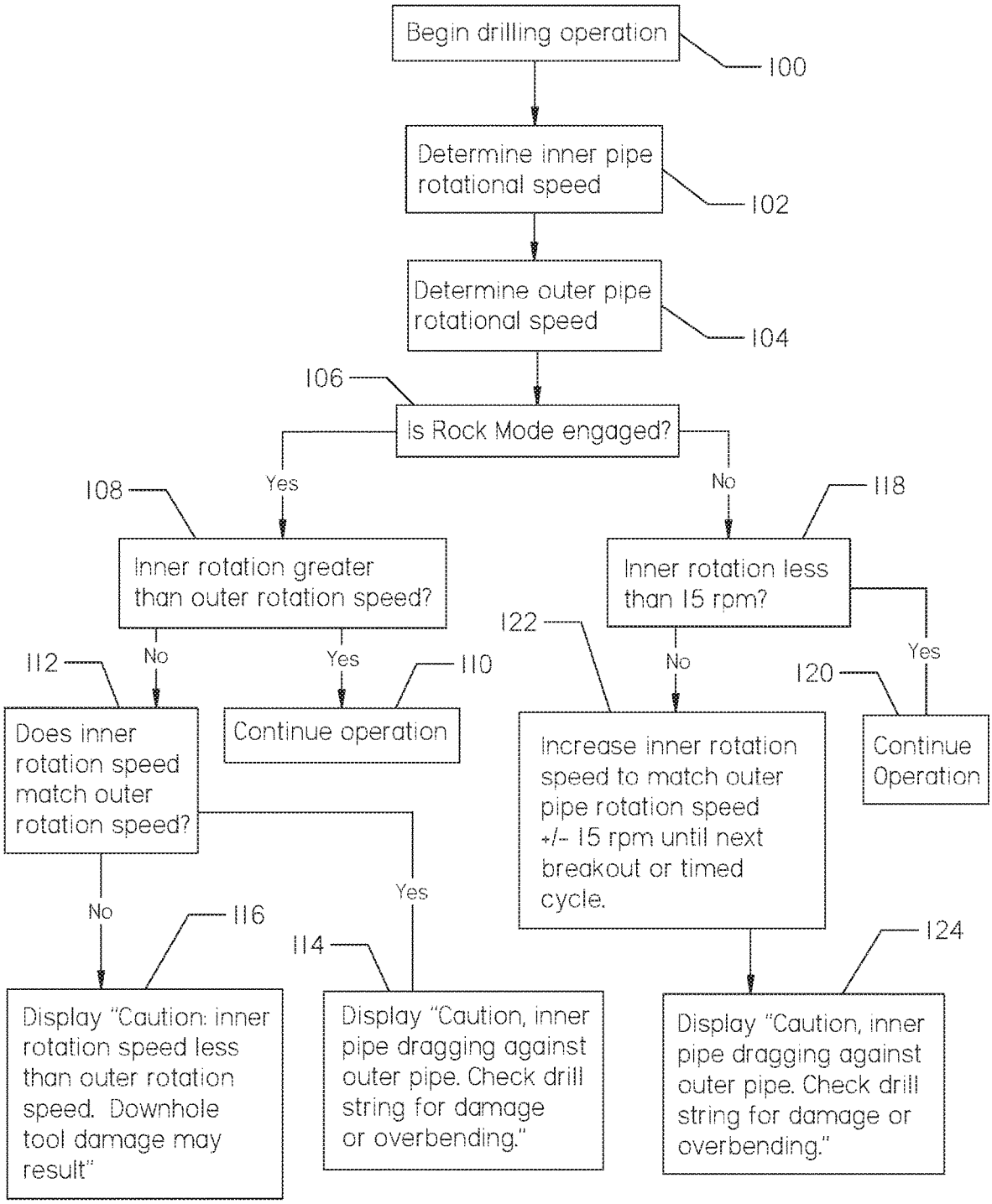
FIG. 4 is a flow chart depicting controller logic for use with the horizontal directional drilling machine.

FIG. 4 shows control logic of the processor. A drilling operation begins at 100. The inner pipe rotation encoder 50 determines the rotational speed of the inner pipe 16 at 102. The outer pipe rotation encoder 52 determines the rotational speed of the outer pipe 18 at 104.

At 106, the processor determines whether or not "Rock Mode" is engaged. If so, the inner pipe 16 is being used to actively rotate the drill bit 20 and advance the drill string 10. In "Rock Mode", the processor determines whether the inner rotation speed is greater than the outer rotation speed at 108. If so, operation is proceeding normally and may continue at 110.

If not, the processor determines if the inner rotation speed is equal to the outer rotation speed at 112. If so, a warning is given at 114 to indicate that the inner pipe is dragging against the outer pipe. The drill string may be damaged or may be overbending. Alternatively, the inner pipe 16 and outer pipe 18 may be automatically stopped to mitigate the issue. If the inner rotation speed is less than the outer rotation speed, a warning is given at 116 indicating that downhole tool damage may occur. Rotation may be stopped, either automatically or by an operator.

If "Rock Mode" is not engaged, the inner pipe 16 is not being rotated by the first rotational motor 30. Rotation speed of the inner pipe 16 is determined at 118 to see if it is below a predetermined threshold, such as 15 rpm. If so, operation may continue at 120. Therefore, the steps at 108, in Rock Mode, and at 118, when not in Rock Mode, should be understood as two possible predetermined drag conditions that the processor is capable of detecting.

If the inner pipe 16 rotation exceeds the threshold, inner rotation may be increased to match the outer pipe 18 rotation speed at 122. This condition may be maintained until step 118 is performed again, either at a predetermined interval or upon pipe breakout. Additionally, a warning may be provided at 124 indicating that the inner pipe 16 is dragging.

If any error condition is met, the event could be logged by date and time or by location in the drill string and date to identify where borehole 24 deviations are present in an HDD borepath or when structural problems may have occurred to the drill string 10.

Changes may be made in the construction, operation and arrangement of the various parts, elements, steps and procedures described herein without departing from the spirit and scope of the invention as described in the following claims.

The invention claimed is:

1. A system, comprising:

a first motor;

a second motor;

an elongate hollow outer member, rotationally coupled to the first motor;

an elongate inner member, rotationally coupled to the second motor, wherein the elongate inner member is disposed within the hollow outer member and independently rotatable relative thereto, a first rotation sensor configured to detect the rotation of the elongate hollow outer member and send a first signal;

a second rotation sensor configured to detect the rotation of the elongate inner member and send a second signal; and a processor comprising a memory, the processor configured to:

store a predetermined drag condition in the memory;

receive the first signal and the second signal;

using the first signal, determine a rotation rate of the elongate hollow outer member;

using the second signal, determine a rotation rate of the elongate inner member; and compare the rotation rate of the inner member and the rotation rate of the elongate hollow outer member to the predetermined drag condition.

2. The system of claim 1 in which the processor is further configured to:

send a warning signal if the predetermined drag condition is met.

3. The system of claim 1 in which the processor is further configured to:

increase the rotation rate of the inner member if the predetermined drag condition is met.

4. The system of claim 1 in which the processor is further configured to:

cease rotation of the inner member and rotation of the outer member if the predetermined drag condition is met.

5. The system of claim 1 in which the predetermined drag condition comprises:

a rotation rate of the elongate inner member in excess of fifteen rotations per minute when the second motor is not providing power to the inner member.

6. The system of claim 1 in which the predetermined drag condition comprises:

the rotation rate of the elongate inner member being no greater than the rotation rate of the elongate hollow outer member.

7. The system of claim 1 in which the first rotation sensor is a magnetic encoder.

8. The system of claim 1 further comprising a drill bit, in which the drill bit is configured to be rotated by rotation of the elongate inner member.

9. The system of claim 1 further comprising a backreamer, in which the backreamer is configured to be rotated by rotation of the elongate hollow outer member.

10. A method of using the system of claim 1, comprising:

placing the system in a first mode, the first mode being associated with the predetermined drag condition stored in the memory;

providing a drill bit at a first end of the elongate hollow outer member and the elongate inner member;

advancing the drill bit through an underground environment;

rotating the drill bit using the elongate inner member;

receiving, at the processor, the first signal and the second signal;

determining, using the first signal and the second signal, the rotation rate of the elongate inner member and a rotation rate of the elongate hollow outer member; and with the processor, comparing the rotation rate of the elongate inner member and the rotation rate of the elongate hollow outer member to the predetermined drag condition associated with the first mode.

11. The method of claim 10 in which the predetermined drag condition of the first mode comprises:

the rotation rate of the elongate inner member being no greater than the rotation rate of the elongate hollow outer member.

12. The method of claim 10 in which the predetermined drag condition of the first mode comprises:

a rotation rate of the elongate inner member in excess of fifteen rotations per minute when the second motor is not rotating the inner member.

13. A method for rotating a drill string, the drill string comprising an outer pipe string and an inner pipe string disposed within the outer pipe string, the method comprising:

storing, in a memory, predetermined drill string rotation conditions indicative of a drag condition between the inner pipe string and the outer pipe string; rotating the inner pipe string using a first motor;

rotating the outer pipe string using a second motor; measuring a first rotation rate of the inner pipe string; measuring a second rotation rate of the outer pipe string; and comparing the first rotation rate and the second rotation rate to the predetermined drill string rotation conditions.

14. The method of claim 13 further comprising:

if the first rotation rate and second rotation rate meet the predetermined drill string rotation conditions, sending a warning signal.

15. The method of claim 13 further comprising:

if the first rotation rate and the second rotation rate meet the predetermined drill string rotation conditions, increasing the first rotation rate.

16. The method of claim 13 further comprising:

if the first rotation rate and the second rotation rate meet the predetermined drill string rotation conditions, rotating the inner pipe string at a rotational velocity equal to the rotational velocity of the outer pipe string.

17. A method for rotating a drill string, the drill string comprising an outer pipe string and an inner pipe string disposed within the outer pipe string, the method comprising: storing, in a memory, predetermined drill string rotation conditions indicative of a drag condition between the inner pipe string and the outer pipe string; rotating the inner pipe string using a first motor; rotating the outer pipe string using a second motor; measuring a first rotation rate of the inner pipe string; measuring a second rotation rate of the outer pipe string; and comparing the first rotation rate and the second rotation rate to the predetermined drill string rotation conditions; if the first rotation rate and the second rotation rate meet the predetermined drill string rotation conditions, rotating the inner pipe string at a rotational velocity equal to the rotational velocity of the outer pipe string; after the step of rotating the inner pipe string at a rotational velocity equal to the rotational velocity of the outer pipe string, discontinuing rotation of the inner pipe string.

18. A method for rotating a drill string, the drill string comprising an outer pipe string and an inner pipe string disposed within the outer pipe string, the method comprising:

providing a backreamer at a distal end of the drill string, the backreamer being rotationally coupled to the outer pipe string;

providing a first motor, the first motor rotationally coupled to the inner pipe string;

rotating the outer pipe string using a second motor;

measuring a first rotation rate of the inner pipe string;

measuring a second rotation rate of the outer pipe string;

determining if the first rotation rate exceeds a predetermined threshold; and if the first rotation rate exceeds a predetermined threshold, rotating the inner pipe string with the first motor such that the first rotation rate and the second rotation rate are equal.

19. The method of claim 18 further comprising:

after rotating the inner pipe string with the first motor such that the first rotation rate and the second rotation rate are equal:

ceasing rotation of the inner pipe string and the outer pipe string;

removing a section of the inner pipe string and the outer pipe string; and thereafter, repeating the steps of:

rotating the outer pipe string using a second motor;

measuring a first rotation rate of the inner pipe string;

measuring a second rotation rate of the outer pipe string;

determining if the first rotation rate exceeds a predetermined threshold; and if the first rotation rate exceeds a predetermined threshold, rotating the inner pipe string with the first motor such that the first rotation rate and the second rotation rate are equal.

20. The method of claim 18 in which the predetermined threshold is fifteen rotations per minute while the first motor is not rotating the inner pipe string.

* * * * *